US005338122A

United States Patent [19]

Eudy

[11] Patent Number: 5,338,122

[45] Date of Patent: Aug. 16, 1994

[54] CONTINUOUS-FEED PAPER, METHOD OF FORMING SINGLE SHEETS FROM CONTINUOUS FEED PAPER,AND METHOD OF FORMING CONTINUOUS FEED PAPER

[76] Inventor: James R. Eudy, 4316 Whitetail La., Charlotte, N.C. 28107

[21] Appl. No.: 947,751

[22] Filed: Sep. 21, 1992

Related U.S. Application Data

[63] Continuation-in-part of Ser. No. 826,820, Jan. 28, 1992, Pat. No. 5,190,386.

[51] Int. Cl.[5] ..... B41J 15/00

[52] U.S. Cl. ..... 400/613.2; 400/621.1; 400/616.2; 281/5; 283/105; 462/25

[58] Field of Search ..... 400/613.2, 613.3, 613.4, 400/616, 616.1, 616.2, 616.3, 621.1, 521, 522, 535; 83/425, 425.2, 426; 281/2, 5; 283/105; 462/6, 7, 8, 25; 428/53

[56] References Cited

U.S. PATENT DOCUMENTS

| | | | |
|---|---|---|---|
| 3,352,740 | 11/1967 | Fleischhauer | 161/112 |
| 3,450,419 | 6/1969 | Eichorn | 281/5 |
| 4,017,655 | 4/1977 | Mutschler | 428/43 |
| 4,285,531 | 8/1981 | Balsamo | 281/5 |
| 4,540,612 | 9/1985 | Rhyner | 281/2 |
| 4,627,994 | 12/1986 | Welsch | 428/41 |
| 4,759,484 | 7/1988 | Richter | 226/6 |
| 4,813,593 | 3/1989 | Pennock | 229/69 |
| 4,814,216 | 3/1989 | Brunett et al. | 281/2 |
| 4,940,347 | 7/1990 | Lund | 400/621.1 |
| 5,219,631 | 6/1993 | Long | 281/5 |

*Primary Examiner*—David A. Wiecking
*Attorney, Agent, or Firm*—W. Thad Adams, III

[57] ABSTRACT

A length of continuous-feed paper, comprising a multiplicity of adjacent paper sheets aligned end-to-end for being fed into a printer. Each of the sheets are defined from adjacent sheets by a cut through the paper, and extending transversely from one side edge of the paper sheet to the other side edge of the paper sheet. First and second continuous paper edge strips are formed on opposite side edges of the paper sheets and extend along the length of the continuous-feed paper for carrying the paper sheets therebetween. The first and second edge strips have sprocket holes therein for permitting the edge strips and the paper sheets carried by the edge strips to be continuously fed through a sprocket-driven printer. The first and second paper edge strips and paper sheets are separable along the length of the continuous-feed paper between the first paper edge strip and one side edge of the paper sheet, and along the length of continuous-feed paper between the second paper edge strip and the other side edge of the paper sheet. Upon separation of the first and second paper edge strips from the paper sheets, the paper sheets become completely separated from each other.

7 Claims, 7 Drawing Sheets

CONTINUOUS-FEED PAPER, METHOD OF FORMING SINGLE SHEETS FROM CONTINUOUS FEED PAPER,AND METHOD OF FORMING CONTINUOUS FEED PAPER

This application is a continuation-in-part of Ser. No. 826,820, filed Jan. 28,1992, now U.S. Pat. No. 5,190,386 issued Mar. 2, 1993.

TECHNICAL FIELD AND BACKGROUND OF THE INVENTION

The invention relates to continuous-feed paper for a continuous-feed printer. The continuous-feed paper is cut into paper sheets and advanced by edge strips on each marginal portion of the paper sheet. The edge strips cooperate with drive sprockets on the printer, and are normally perforated. As the paper sheets are advanced through the printer, the edge strips are removed, thus causing each sheet to be discharged from the printer clean-cut and separate.

Recent developments in sprocket-driven computer printers have sought to alleviate some of the drawbacks in the use of normal, continuous-feed paper. Patent application No. 826,820 of the present applicant discloses a sprocket-driven printer which removes paper edge strips from continuous-feed paper as the printer discharges the paper. This invention has effectively eliminated the problem of manually removing these perforated edge strips.

However, problems with continuous-feed paper and its use with continuous-feed printers still exist, particularly the problem of page separation. Page separation is a tedious job, especially when printing voluminous documents. Regardless of the degree of care taken to produce a clean page break, often times separation leaves ragged edges along the perforation line and remnants of the once attached adjacent sheets. The present invention eliminates the need to manually separate each sheet of paper by eliminating bottom and top page perforations between adjacent sheets, and providing instead a clean cut between sheets. This result is also achieved by manually removing the edge strips from the continuous-feed paper.

The invention of this application produces individual, clean-cut paper sheets by feeding the novel continuous-feed paper through a printer containing edge strip trimmers, or by removing the edge strips manually after printing.

SUMMARY OF THE INVENTION

Therefore it is an object of the invention to provide a length of continuous-feed paper which separates into individual paper sheets when the paper edge strips holding the sheets together are removed.

It is another object of the invention to provide a method of inputting continuous-feed paper into, and outputting separate paper sheets from, a continuous-feed sprocket-driven printer.

It is another object of the invention to produce a length of continuous-feed paper having the paper sheets separated by a cut extending transversely from one side edge to the other, and attached in succession by means of paper edge strips.

It is another object of the invention to provide a continuous-feed paper product wherein a plurality of layers of continuous-feed paper are overlaid in registration with each other to form a multi-layer continuous-feed paper product for producing multiple copies of printed documents in a single pass through the printer.

It is another object of the invention to provide a method of manufacturing a continuous-feed paper product which can be fed through continuous-feed printers and automatically separated in to single sheets as the paper product exits the printer.

These and other objects of the present invention are achieved in the preferred embodiments disclosed below by providing a length of continuous-feed paper, including a multiplicity of adjacent paper sheets aligned end-to-end for being fed into a printer. Each of the sheets is defined from adjacent sheets by a cut through the paper. The cut extends transversely from one side edge of the paper sheet to the other side edge of the paper sheet. First and second continuous paper edge strips are formed on opposite side edges of the paper sheets and extend along the length of the continuous-feed paper for carrying the paper sheets therebetween. The first and second edge strips have sprocket holes therein for permitting the edge strips and the paper sheets carried by the edge strips to be continuously fed through a sprocket-driven printer. The first and second paper edge strips and paper sheets are separable along the length of the continuous-feed paper between the first paper edge strip and one side edge of the paper sheet, and along the length of the continuous-feed paper between the second paper edge strip and the other side edge of the paper sheet. Upon separation of the first and second paper edge strips from the paper sheets, the paper sheets are completely separated from each other.

According to one preferred embodiment of the invention, a length of continuous-feed paper comprises first and second paper edge strips and paper sheets separable by a first perforation line extending along the length of the continuous-feed paper between the first paper edge strip and one side edge of the paper sheet, and a second perforation line extending along the length of the continuous-feed paper between the second paper edge strip and the other side edge of the paper sheet.

An embodiment of the method according to the invention comprises the steps of inputting continuous-feed paper into, and outputting separate paper sheets from, a continuous-feed sprocket-driven printer. The method includes the steps of providing a length of continuous-feed paper with a multiplicity of adjacent paper sheets aligned end-to-end for being fed into a printer. Each of the sheets is defined from adjacent sheets by a cut through the paper. The cut extends transversely from one side edge of the paper sheet to the other side edge of the paper sheet. First and second continuous paper edge strips are formed on opposite side edges of the paper sheets and extend along the length of the continuous-feed paper for carrying the paper sheets therebetween.

The first and second edge strips have sprocket holes therein for permitting the edge strips and the paper sheets carried by the edge strips to be continuously fed through a sprocket-driven printer. The first and second paper edge strips and the paper sheets are separable along the length of the continuous-feed paper between the first paper edge strip and one side edge of the paper sheet and along the length of the continuous-feed paper between the second paper edge strip and the other side edge of the paper sheet. The continuous-feed paper is fed through a continuous-feed, sprocket-driven printer. First and second edge strips are detached from the paper sheets as the paper sheets exit the printer, thereby forming separate paper sheets.

According to yet another preferred embodiment of the invention the step of providing the edge strips further includes the step of perforating the paper in predetermined, spaced-apart relation to the side edges of the continuous-feed paper to form a first perforation line extending along the length of the continuous-feed paper between the first paper edge strip and one side edge of the paper sheet, and a second perforation line extending along the length of the continuous-feed paper between the second paper edge strip and the other side edge of the paper sheet. The step of detaching the edge strips from the paper sheets includes the step of bursting the perforations.

According to yet another preferred embodiment of the invention, a continuous-feed paper product is formed by the process including the steps of providing a length of continuous-feed paper with a multiplicity of adjacent paper sheets aligned end-to-end for being fed into a printer. A transverse cut is made through the paper at predetermined intervals along the length of the continuous-feed paper and defines separable paper sheets, leaving marginal areas between the cuts and the side edges of the continuous-feed paper to be formed into edge strips. First and second continuous paper edge strips are formed on opposite side edges of the paper sheets and extend along the length of the continuous-feed paper for carrying the paper sheets therebetween. The first and second paper edge strips and the paper sheets are separable along the length of continuous-feed paper between the first paper edge strip and one side edge of the paper sheet, and along the length of the continuous-feed paper between the second paper edge strip and the other side edge of the paper sheet. Sprocket holes are punched at spaced-apart intervals in the first and second edge strips for permitting the edge strips and the paper sheets carried by the edge strips to be continuously fed through a sprocket-driven printer.

Preferably, the step of forming the edge strips includes the step of forming a first perforation line extending along the length of the continuous-feed paper between the first paper edge strip and one side edge of the paper sheet, and a second perforation line extending along the length of the continuous-feed paper between the second paper edge strip and the other side edge of the paper sheet.

According to yet another preferred embodiment of the invention, a plurality of layers of continuous-feed paper are overlaid in registration with each other to form a multi-layer continuous-feed paper product for producing multiple copies of printed documents in a single pass through the printer.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF PREFERRED EMBODIMENT AND BEST MODE

Figure 1:
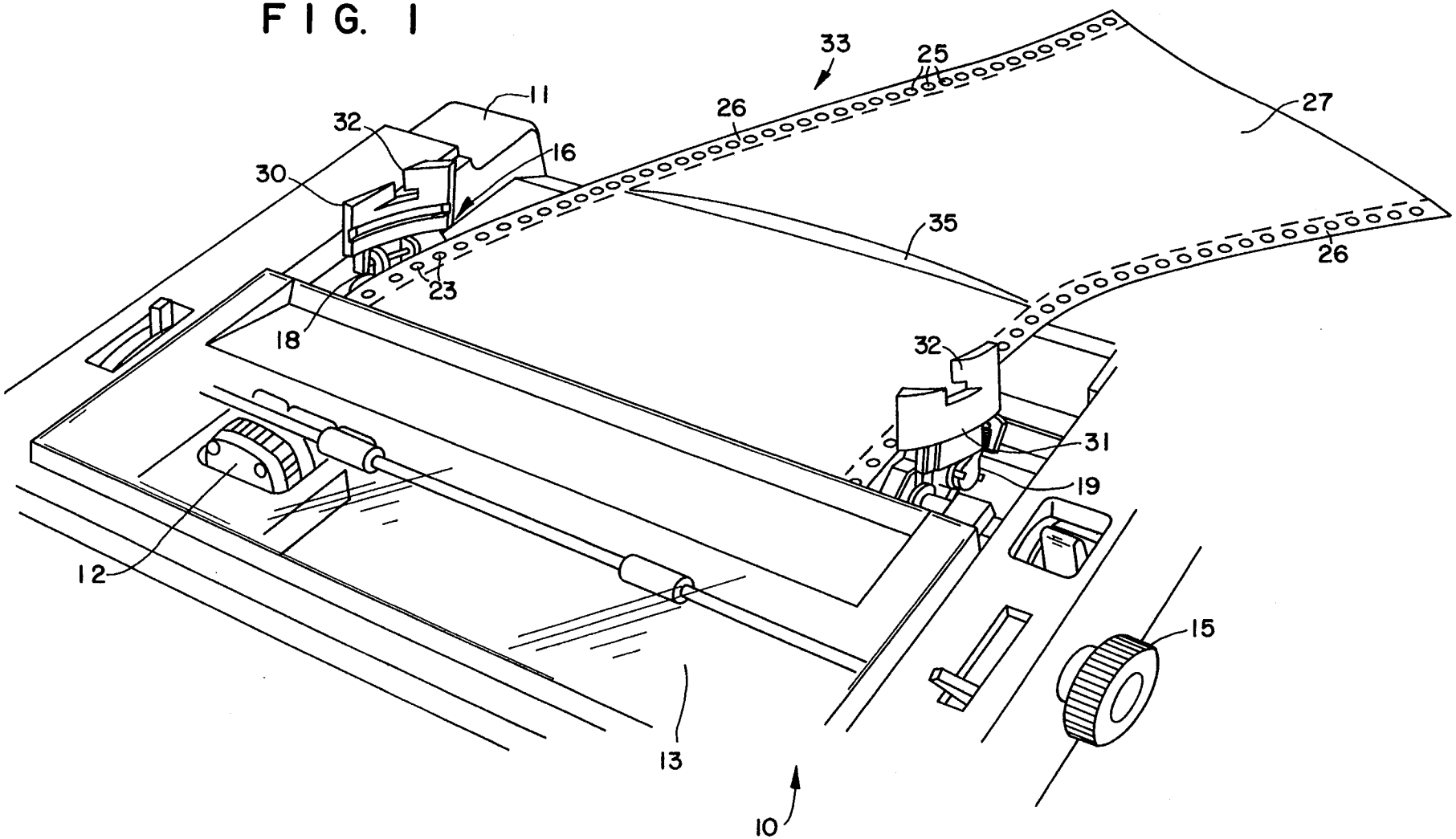
FIG. 1 is a fragmentary perspective view of a sprocket-driven printer with edge strip trimmers.

Referring now specifically to the drawings, a sprocket-driven printer providing for automatic removal of paper edge strips is illustrated in FIG. 1, and shown generally at broad reference numeral 10. The printer 10 includes a printer housing 11, a print head 12, a transparent cover 13, and a platen to which a platen knob 15 is attached for manual feeding of the paper through the printer 10. Of course, this invention is applicable to any type of continuous-feed printer.

Continuous-feed paper sheets are pulled through the printer 10 by a tractor feed apparatus 16. The tractor feed apparatus 16 includes a pair of tractor feed sprocket wheels 18 and 19 which are spaced-apart a proper distance to accommodate paper sheets of a given width. As shown in FIG. 1, sprockets 18 and 19 are adjusted to accommodate the full-width paper sheets of the continuous-feed paper length.

Figure 2:
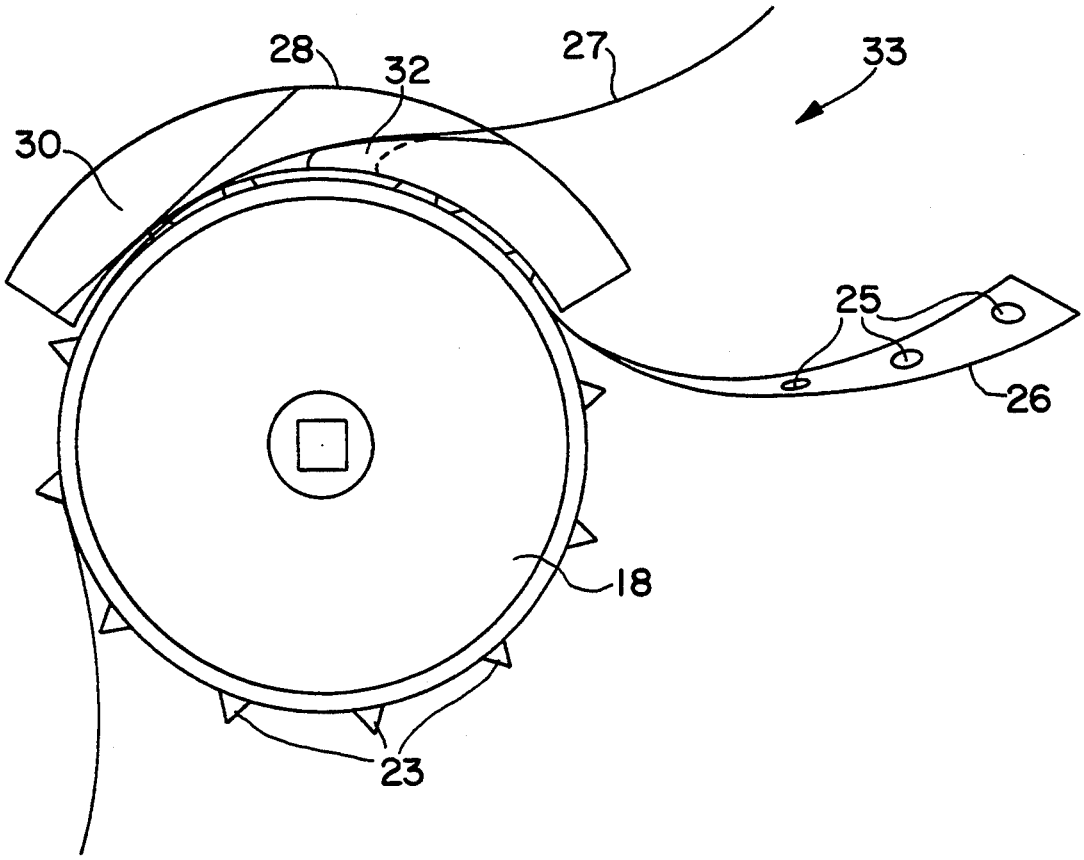
FIG. 2 is a side elevation of a edge strip trimmer, showing the feed paths of the edge strip and the paper sheet through the edge strip trimmer.

As is best shown in FIG. 2, sprocket wheels 18 and 19 have sprocket teeth 23 molded into their respective axially-extending peripheral surfaces.

These sprocket teeth 23 are spaced to match the spacing of holes 25 in an edge strip 26. The edge strips 26 are held onto the sprocket wheels 18 and 19 by a pair of edge strip trimmers 30 and 31, thereby acting as covers. The edge strip trimmers 30 and 31, referenced in FIG. 1, are pivoted, and flip into place over respective sprocket wheels 18 and 19. The edge strip trimmers 30 and 31 define a narrow space between the edge strip trimmers 30 and 31 and respective sprocket wheels 18 and 19 which hold the edge strips 26 onto the sprocket teeth 23, but allow enough space to permit unrestricted movement of the edge strips 26 between them.

Again referring to FIG. 1, two edge strip trimmers 30 and 31 are shown in an inoperative position above the sprocket wheels 18 and 19, respectively. The edge strip trimmers 30 and 31 are identical mirror images of each other.

Edge strip trimmer 30, as illustrated in FIG. 2, is positioned above the sprocket wheel 18. The edge strip trimmer 30 is pivotable between an inoperative position, as shown in FIG. 1, and a closed, operative position shown in FIGS. 2 and 5. The path of the edge strip 26 and the paper sheet 27 through the edge strip trimmer 30 is illustrated in FIG. 2.

An inclined paper support bed contained on edge strip trimmers 30 and 31 is shown at reference numeral 32 in FIGS. 1 and 2. The support bed is ramped and progressively diverges the plane of the edge strip from the plane of the paper sheet as the paper sheets are successively fed through the printer 10.

Figure 3:
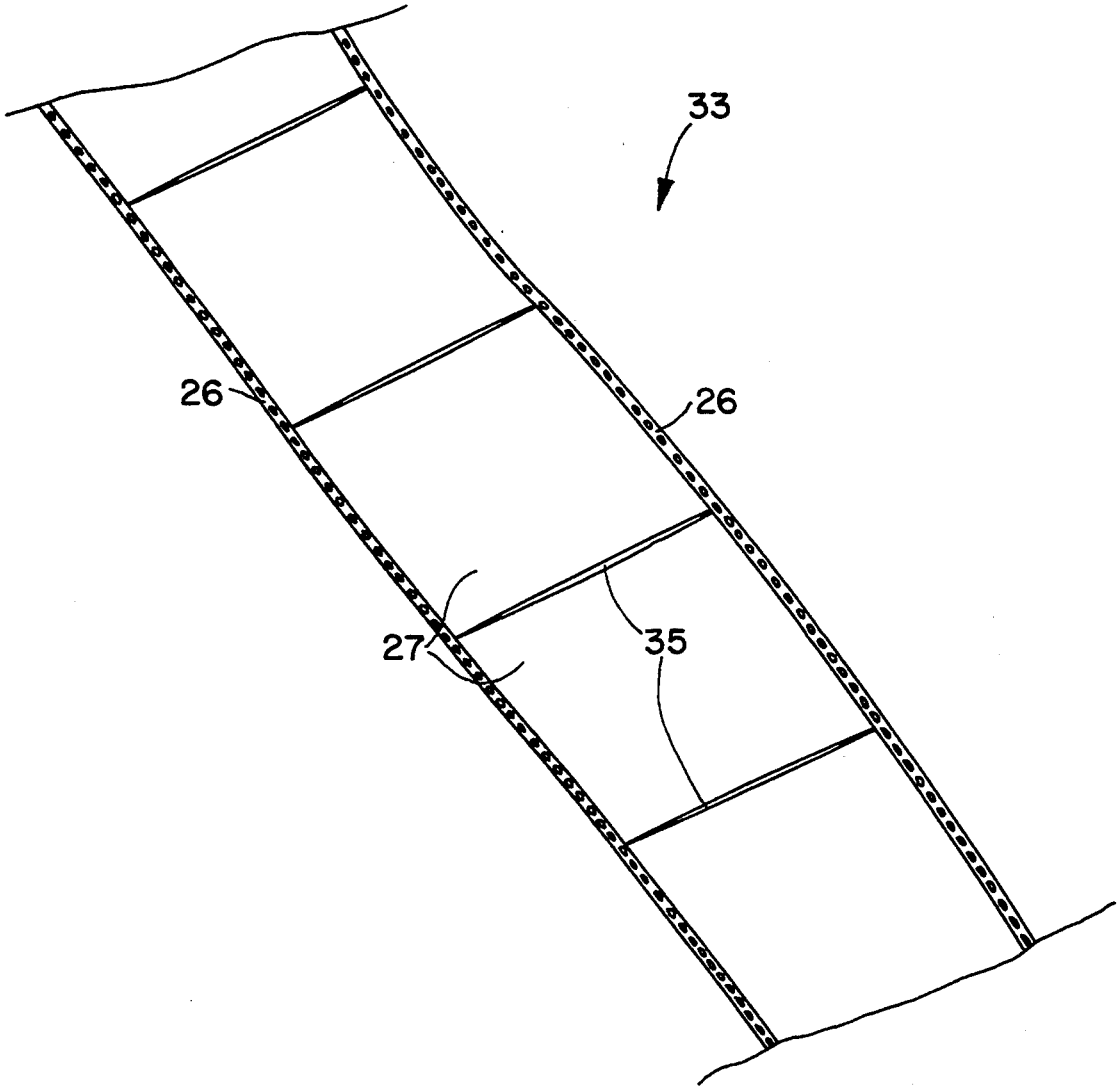
FIG. 3 is a perspective view of a length of continuous-feed paper according to one embodiment of the invention.
Figure 4:
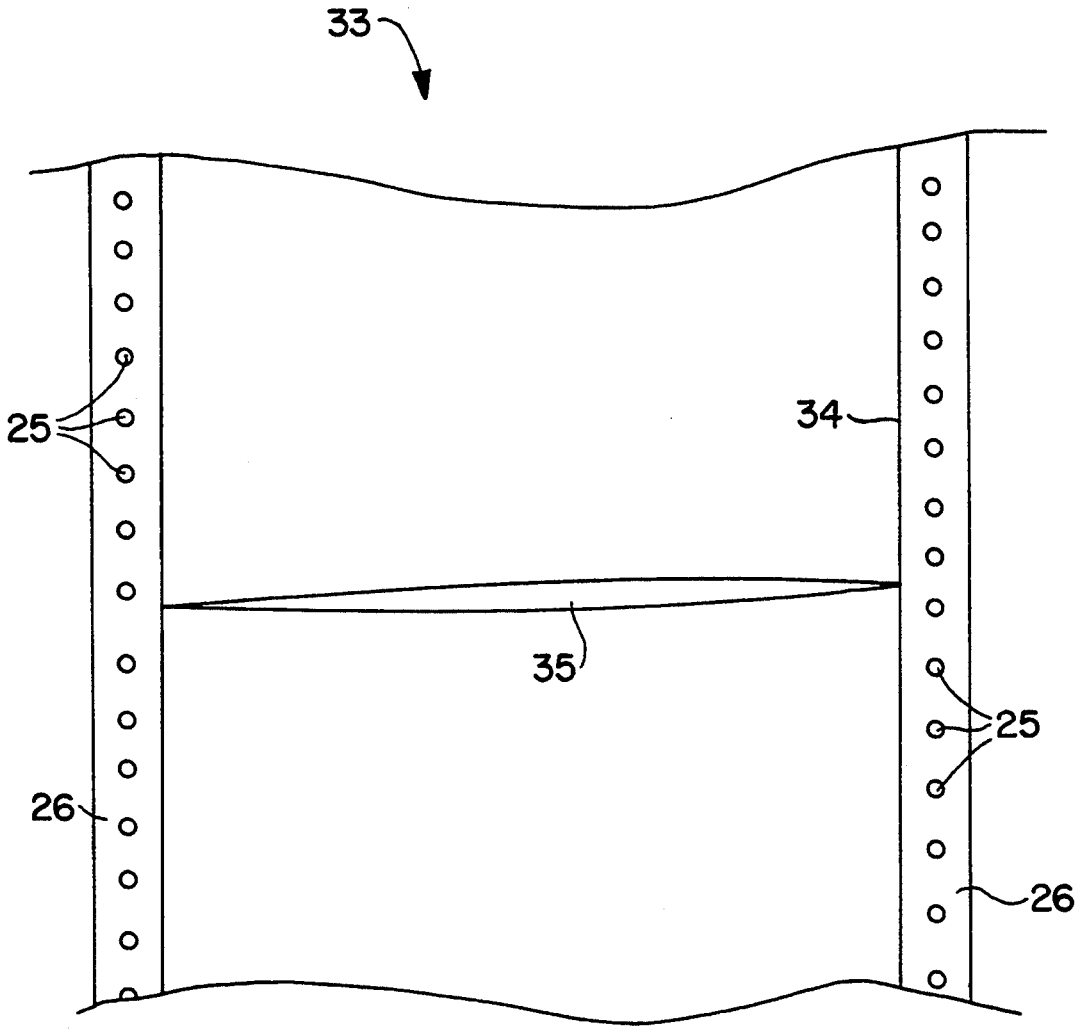
FIG. 4 is a fragmentary enlargement of FIG. 3, showing the cut separating the paper sheets.

Referring now to FIG. 3, a length of continuous-feed paper according to the invention is illustrated, and referenced generally at 33. The continuous-feed paper 33 includes paper sheets 27 attached in succession by means of marginal edge strips 26. Preferably, the edge strips 26 are defined by longitudinally-extending perforations, as shown in FIG. 4 at reference numeral 34. The edge strips 26 run longitudinally adjacent the paper sheets 27. Holes 25 are punched in the edge strips 26 for receiving sprocket teeth 23 contained on sprocket wheels 18 and 19.

A cut 35, transversely extending from one paper sheet edge to the other, defines the separate paper sheets 27, best illustrated in FIG. 4. In typical form, the continuous-feed paper 33 would comprise 8.5 by 11 inch paper sheets 27, with edge strips 26 each 0.5 inches wide. The continuous-feed paper 33 may be contained and received in rolled form, or the more conventional fan-folded stack form commonly utilized with prior art continuous-feed paper.

Figure 5:
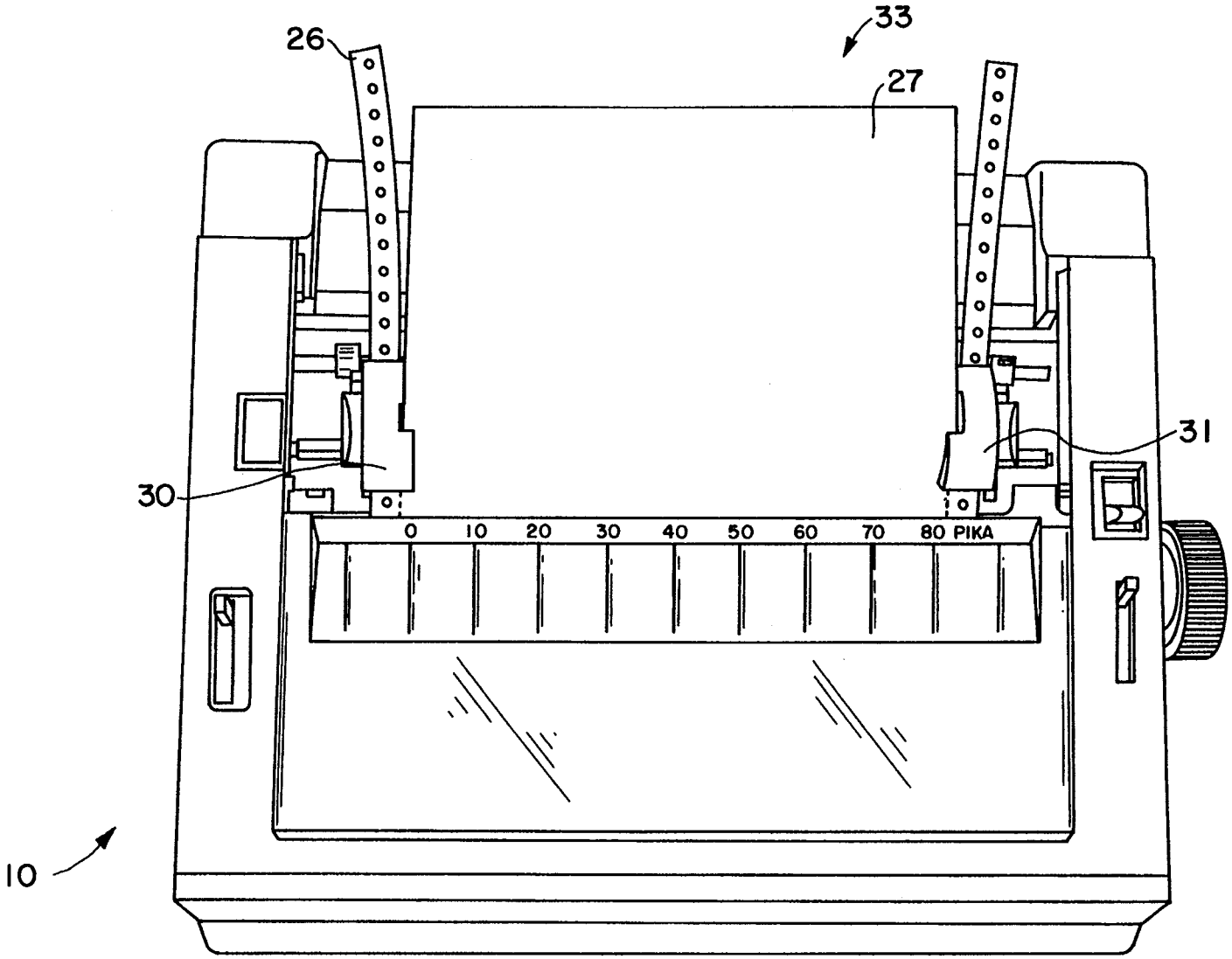
FIG. 5 is a modified plan view of a sprocket-driven printer with a pair of edge strip trimmers in their operative positions.

Referring now to FIG. 5, as the continuous-feed paper 33 passes from the printer 10 through the edge strip trimmers 30 and 31, the paper sheet 27 and the edge strips 26 separate, thereby automatically releasing the paper sheets 27 from the edge strips 26 and from each other.

FIG. 1 illustrates this process with the edge strip trimmers 30 and 31 in an inoperative position. As is apparent, since the edge strips 26 are not removed, the paper sheets 27 remain attached. The paper sheets 27 can be separated from each other by manual removal of the edge strips 26 once printing is completed. Thus, the invention is also equally suitable for use with conventional continuous-feed printers without paper edge trimmers.

Figure 6:
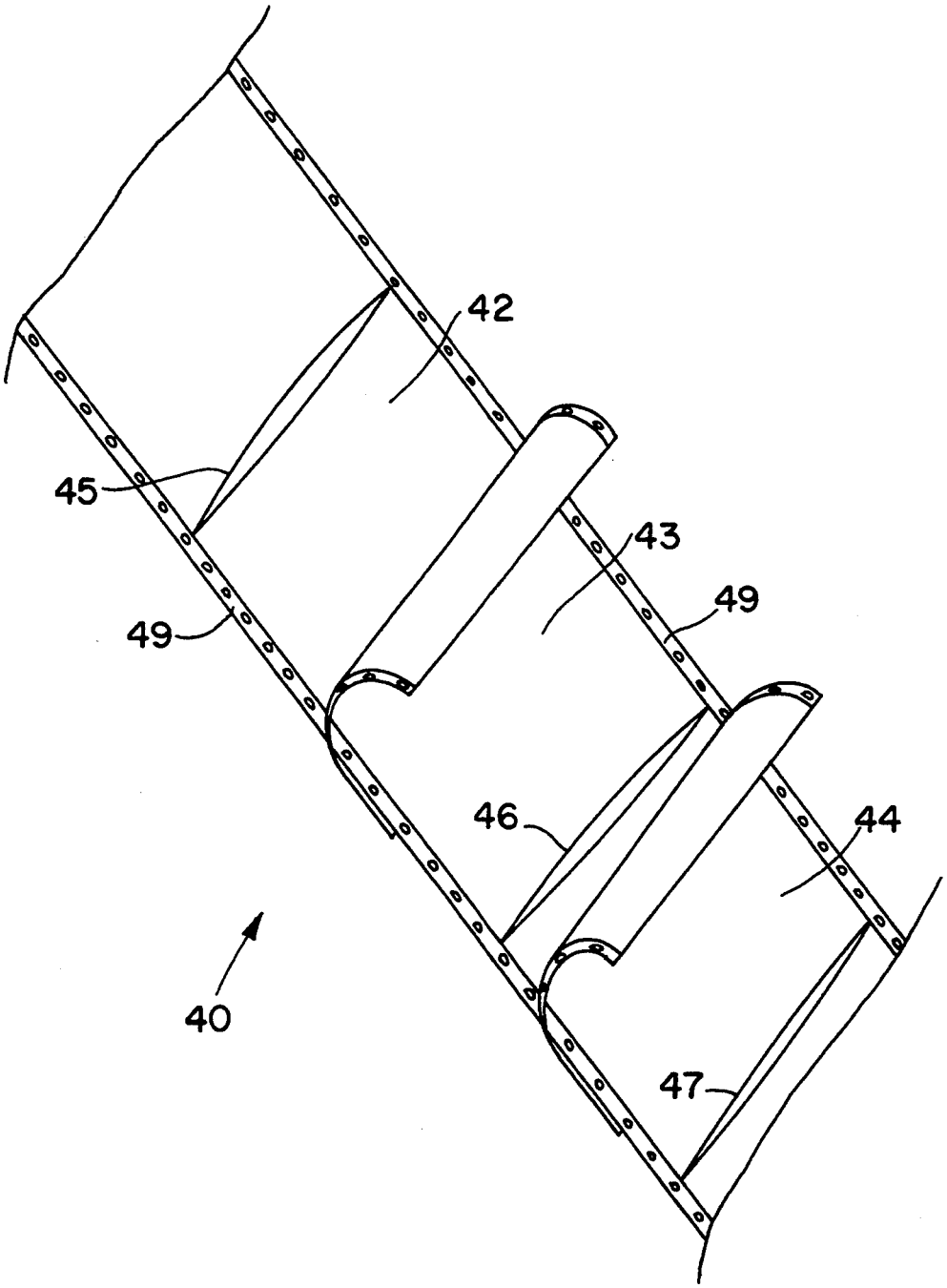
FIG. 6 is a perspective view of a modified embodiment of the invention, showing the lengths in an overlaid position for printing multiple copies.

A continuous-feed product paper 40 according to the invention also allows for selective separation of a plurality of paper sheets 42, 43, 44 overlaid as illustrated in FIG. 6, and simultaneously passed through the printer 10.

Figure 7:
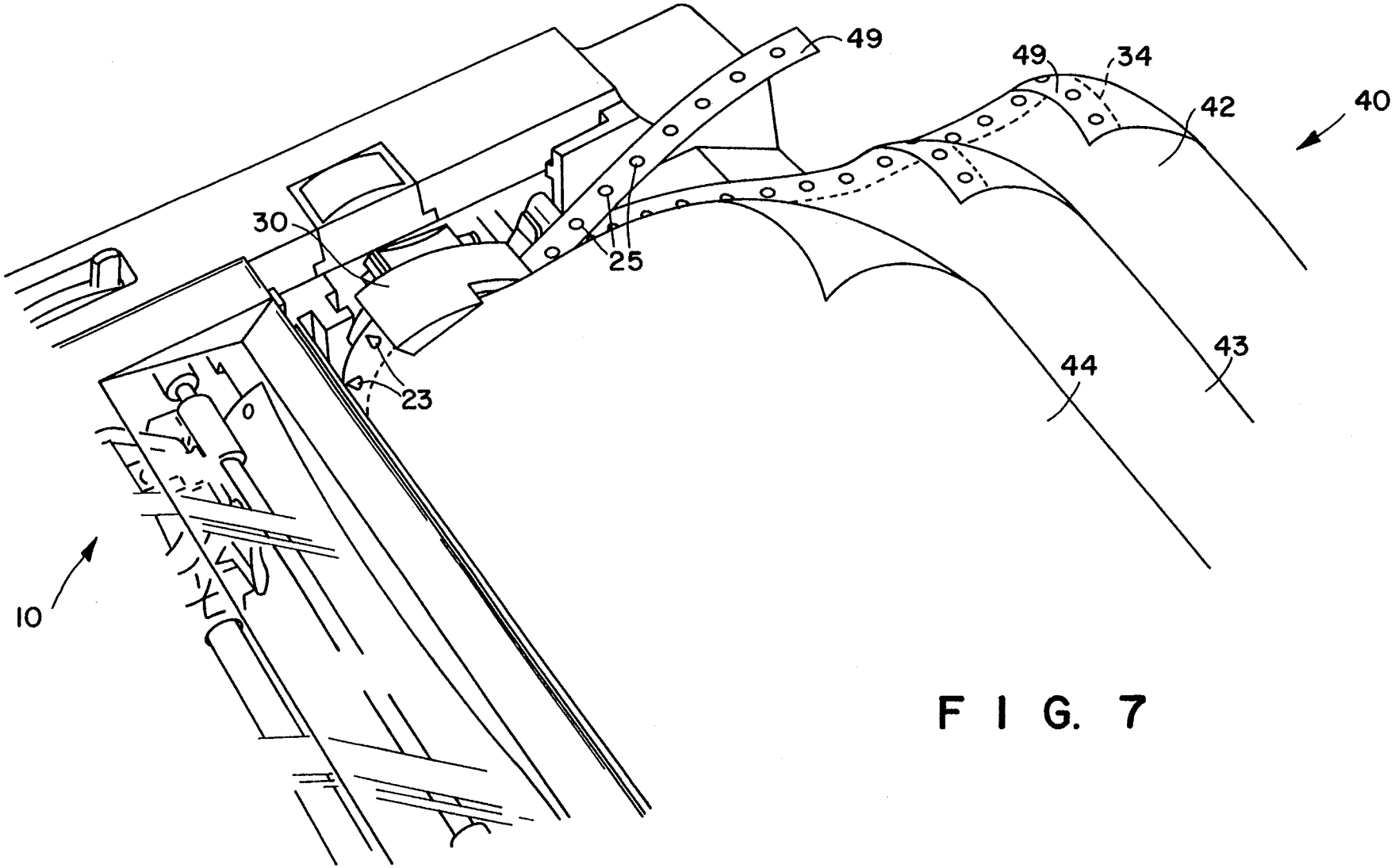
FIG. 7 is an enlarged fragmentary perspective view of a edge strip trimmer and feed sprocket, showing how less than all of several paper sheets can be separated in a single pass through the printer.

Paper sheets 42, 43, 44 are defined by cuts 45, 46, 47, respectively, which are in registration with each other. Edge strips 49, as described above with reference to edge strips, permit the paper product 40 to be fed through the printer. As shown in FIG. 7, the design of the continuous-feed paper 40 and the edge strip trimmer 30 permits selective separation of the edge strips 49 from one or more, or all, of the plurality of page sheets 42, 43, 44.

For example, this can be accomplished by positioning the paper sheets 42 and 43 which are not to be separated under the support beds 32 of edge strip trimmers 30 and 31 so that the paper sheets 42 and 43 remain in the same horizontal plane as the respective edge strips 49. The paper sheet 44 to be separated from its edge strips 49, and otherwise disconnected from successive paper sheets 44, is positioned to feed over the support bed 32, as described above. The two bottom paper sheets 42 and 43 and the still-attached edge strips 49 feed through the edge strip trimmer 30 without separating, while the top paper sheet 44 passes over the support bed 32 and separates from its edge strip 49. This process separates the paper sheet 44 from successive, still-attached paper sheets 44.

When, for whatever reason, none of the edge strips 49 or paper sheets 42, 43, 44 are to be then separated from each other, then all of the paper sheets 42, 43, 44 are fed under the support bed 32. The paper product 40 feeds through the edge strip trimmers 30 and 31, and none of the edge strips 49 are removed.

The formation of a continuous-feed paper product 33 includes a process comprising the steps of providing a length of continuous-feed paper 33, including a multiplicity of adjacent paper sheets 27 aligned end-to-end for being fed into a printer 10. The paper sheets 27 are transversely cut through 35 at predetermined intervals along the length of the continuous-feed paper 33 to define separable paper sheets 27, leaving marginal areas between the cuts 35 and the side edges of the continuous-feed paper 33 to be formed into edge strips 26. First and second continuous paper edge strips 26 are formed on opposite side edges of the paper sheets 27, and extend along the length of the continuous-feed paper 33 for carrying the paper sheets 27 therebetween. The first and second paper edge strips 26 and the paper sheets 27 are separable along the length of continuous-feed paper 33 between the first paper edge strip 26 and one side edge of the paper sheet 27, and along the length of the continuous-feed paper 33 between the second paper edge strip and the other side edge of the paper sheet 27. Sprocket holes 25 are punched at spaced-apart intervals in the first and second edge strips 26 for permitting the edge strips 26 and the paper sheets 27 carried by the edge strips 26 to be continuously fed through a sprocket-driven printer 10.

The transverse cutting, edge strip perforating and sprocket hole punching steps do not necessarily need to be carried out in the sequence stated above.

A continuous-feed paper, process for making continuous-feed paper and a process for outputting separate paper sheets from a continuous-feed is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A method of inputting continuous-feed paper into, and outputting separate paper sheets from, a continuous-feed sprocket-driven printer, comprising the steps of:

(a) providing a length of continuous-feed paper including a multiplicity of adjacent paper sheets aligned end-to-end for being fed into a printer, each of said paper sheets being defined from adjacent paper sheets by a single cut through the paper, said cut extending transversely from one side edge of the paper sheet to the other side edge of the paper sheet;

(b) providing first and second transversely non-perforated continuous paper edge strips formed on opposite side edges of the paper sheets and extending continuously along the length of the continuous-feed paper for connecting together adjacent paper sheets and for carrying the paper sheets therebetween, said first and second edge strips having sprocket holes therein for permitting the edge strips and the paper sheets carried by said edge strips to be continuously fed through a sprocket-driven printer, said first and second paper edge strips and said paper sheets being separable along the length of the continuous-feed paper between said first paper edge strip and one side edge of said paper sheet and along the length of continuous-feed paper between said second paper edge strip and the other side edge of said paper sheet;

(c) feeding said continuous-feed paper through a continuous-feed, sprocket-driven printer; and (d) detaching the first and second edge strips from said paper sheets as said paper sheets exit the printer, thereby forming separate paper sheets;

whereby, upon separation of the first and second paper edge strips from the paper sheets, the paper sheets are completely separated from each other.

2. A method of inputting continuous-feed paper into, and outputting separate paper sheets from, a continuous-feed sprocket-driven printer according to claim 1, wherein the step of providing said edge strips further comprises the step of perforating the paper in predetermined, spaced-apart relation to the side edges of the continuous-feed paper to form a first perforation line extending along the length of the continuous-feed paper between said first paper edge strip and one side edge of said paper sheet, and a second perforation line extending along the length of continuous-feed paper between said second paper edge strip and the other side edge of said paper sheet, and the step of detaching the edge strips from the paper sheets comprises the step of bursting the perforations.

3. A length of continuous-feed paper, comprising:

(a) a multiplicity of adjacent paper sheets aligned end-to-end for being fed into a printer, each of said paper sheets being defined from adjacent paper sheets by a single cut through the paper, said cut extending transversely from one side edge of the paper sheets to the other side edge of the paper sheets;

(b) first and second transversely non-perforated continuous paper edge strips formed on opposite side edges of the paper sheets and extending continuously along the length of the continuous-feed paper for connecting together adjacent paper sheets and for carrying the paper sheets therebetween, said first and second edge strips having sprocket holes therein for permitting the edge strips and the paper sheets carried by said edge strips to be continuously fed through a sprocket-driven printer; and (c) said first and second paper edge strips and said paper sheets being separable along the length of the continuous-feed paper between said first paper edge strip and one side edge of said paper sheet and along the length of continuous-feed paper between said second paper edge strip and the other side edge of said paper sheet;

whereby, upon separation of the first and second paper edge strips from the paper sheets, the paper sheets are completely separated from each other.

4. A length of continuous-feed paper according to claim 3, wherein said first and second paper edge strips and said paper sheets are separable by a first perforation line extending along the length of the continuous-feed paper between said first paper edge strip and one side edge of said paper sheet and a second perforation line extending along the length of continuous-feed paper between said second paper edge strip and the other side edge of said paper sheet.

5. A continuous-feed paper product formed by the process having the steps of:

(a) providing a length of continuous-feed paper including a multiplicity of adjacent paper sheets aligned end-to-end for being fed into a printer;

(b) transversely cutting through the paper at predetermined intervals along the length of the continuous-feed paper to define separable paper sheets, leaving marginal areas between the cuts and the side edges of the continuous-feed paper to be formed into continuous edge strips;

(c) forming first and second transversely non-perforated continuous paper edge strips on opposite side edges of the paper sheets and extending continuously along the length of the continuous-feed paper for carrying the paper sheets therebetween, said first and second paper edge strips and said paper sheets being separable along the length of continuous-feed paper between said first paper edge strip and one side edge of said paper sheet and along the length of continuous-feed paper between said second paper edge strip and the other side edge of said paper sheet; and (d) punching sprocket holes at spaced-apart intervals in said first and second edge strips for permitting the edge strips and the paper sheets carried by said edge strips to be continuously fed through a sprocket-driven printer;

whereby, upon separation of the first and second paper edge strips from the paper sheets, the paper sheets are completely separated from each other.

6. A continuous-feed paper product according to claim 5, the step of forming the edge strips includes the step of forming a first perforation line extending along the length of the continuous-feed paper between said first paper edge strip and one side edge of said paper sheet, and a second perforation line extending along the length of continuous-feed paper between said second paper edge strip and the other side edge of said paper sheet.

7. A continuous-feed paper product according to claim 5, wherein and including the step of overlaying a plurality of continuous-feed paper produced according to the steps of claim 5 to form a multi-layer continuous-feed paper product for producing multiple copies of printed documents in a single pass through the printer.

* * * * *